United States Patent [19]

Eckert et al.

[11] 3,946,714

[45] Mar. 30, 1976

[54] FUEL INJECTION SYSTEM

[75] Inventors: Konrad Eckert, Stuttgart-Feuerbach; Gerhard Stumpp, Stuttgart, both of Germany

[73] Assignee: Robert Bosch GmbH, Stuttgart, Germany

[22] Filed: Mar. 13, 1975

[21] Appl. No.: 558,005

[30] Foreign Application Priority Data

Mar. 16, 1974 Germany ..... 2412808

[52] U.S. Cl. 123/139 AW; 123/32 AE; 123/139 AS

[51] Int. Cl.[2] ..... F02M 39/00; F02B 3/00

[58] Field of Search .. 123/139 AW, 139 BG, 139 E, 123/139 AS, 32 AE, 119 R

[56] References Cited

UNITED STATES PATENTS

| | | | |
|---|---|---|---|
| 3,809,036 | 5/1974 | Knapp | 123/139 AW |
| 3,842,813 | 10/1974 | Eckert | 123/139 AW |

*Primary Examiner*—Charles J. Myhre
*Assistant Examiner*—Ronald B. Cox
*Attorney, Agent, or Firm*—Edwin E. Greigg

[57] ABSTRACT

A fuel injection system for externally ignited internal combustion engines including fuel injection nozzles, a fuel distributor unit, a fuel supply circuit, and a control pressure circuit. The distributor unit includes metering valves, pressure valves and a first throttle which separates the fuel supply circuit from the control pressure circuit. At least one of the pressure valves is embodied as a differential pressure control valve which has one chamber connected to the first throttle and the control pressure circuit. The control pressure circuit includes the above-mentioned chamber of the differential pressure control valve, a magnetic valve, a storage element and a second throttle. With the system noted, the pressure difference across the metering valves may be varied by varying the pressure difference across the first throttle by means of the magnetic valve via the storage element and the second throttle.

5 Claims, 3 Drawing Figures

FUEL INJECTION SYSTEM

BACKGROUND OF THE INVENTION

The present invention relates to a fuel injection system for externally ignited internal combustion engines.

The system comprises a distributor unit and metering valves wherein metering is effected with a constant pressure difference. The metering valves are displaceable in common so as to vary their flow passage section and regulate the quantity of fuel flowing to the injection nozzles. In the fuel flow downstream of each of the metering valves there is connected a valve, the flow passage section of which may be varied by a flexible member separating two chambers, in the first chamber of which the pressure urges the flexible member in an opening direction. At least one of the valves, downstream of the metering valves, is in the form of a constant pressure valve, while at least one valve is in the form of a differential pressure control valve, the first chamber of which communicates with the second chamber of each constant pressure valve.

The purpose of the above-mentioned type of injection system is to obtain a corresponding change in the flow passage section of the metering valves with the regulated fuel quantity corresponding to the operating conditions of the engine acting on the metering valve and by means of as constant a pressure drop as possible through this flow passage section resulting in a uniform, exact metering of fuel as a function of the magnitude of the flow passage section, and with such metering being independent of the pressures downstream or upstream of the metering point.

In the known injection systems of this type the fuel for the individual cylinders of the engine is metered collectively by a leading edges of a servo valve spool at different control slots. While metering is carried out, a constant pressure difference is maintained which is electromagnetically varied as a function of the engine characteristics by means of a differential pressure control valve. However, this necessitates a relatively high construction cost.

OBJECT AND SUMMARY OF THE INVENTION

It is a principal object of the present invention to provide a fuel injection system of the known type which is inexpensive to produce while yet achieving the requirements of such injection systems.

It is another object of the present invention to provide a fuel injection system including a control pressure circuit and a throttle which together can control the pressure difference across the metering valves of the system.

These and other objects are achieved according to the present invention in that between the fuel supply line and a control pressure circuit there is disposed a first throttle and downstream thereof the second chamber of the differential pressure control valve and in that the pressure difference across the metering valves may be varied by changing the pressure difference across the first throttle by means of a magnetic valve via a storage element and a second throttle.

An advantageous feature of the present invention consists in that the storage element, the second throttle and the magnetic valve are connected in series in the control pressure circuit and a third throttle is disposed parallel to the magnetic valve.

Another advantageous feature of the present invention consists in that the constant pressure valve is in the form of a flat seat valve comprising a membrane as the flexible member.

A further advantageous feature of the present invention consists in that the differential pressure control valve is in the form of a flat seat valve comprising a membrane as the flexible member, this membrane being urged in the opening direction by a spring having a flat characteristic.

Other objects, features and advantages of the present invention will be made apparent in the following detailed description of a preferred embodiment thereof which is provided in conjunction with the accompanying drawings.

DESCRIPTION OF THE PREFERRED EMBODIMENT

Figure 1:
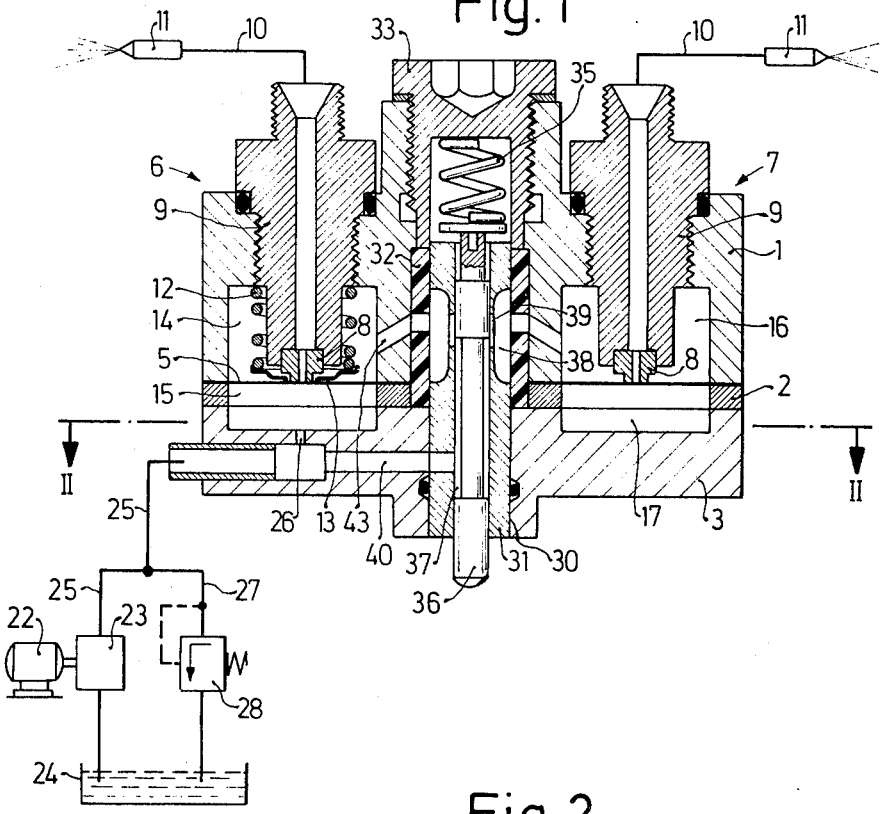
FIG. 1 illustrates in cross section and schematically a portion of the embodiment of the fuel injection system according to the present invention.
Figure 2:
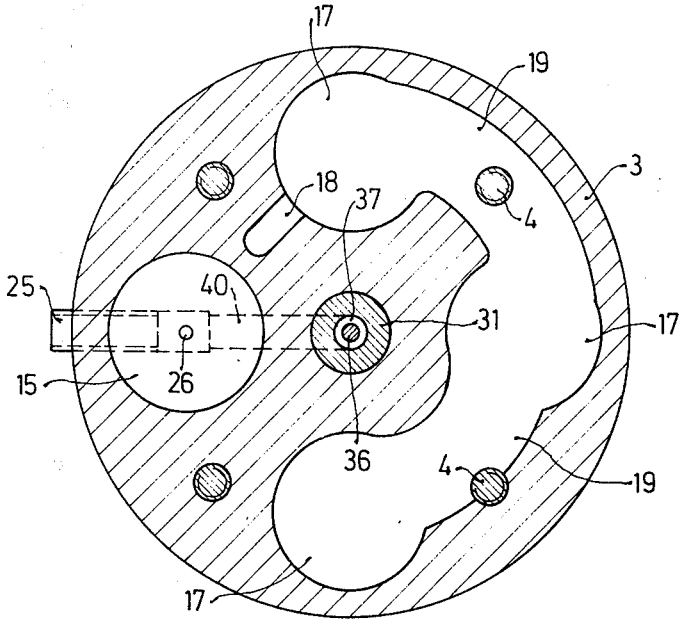
FIG. 2 is a cross sectional view taken along the line II—II in FIG. 1.
Figure 3:
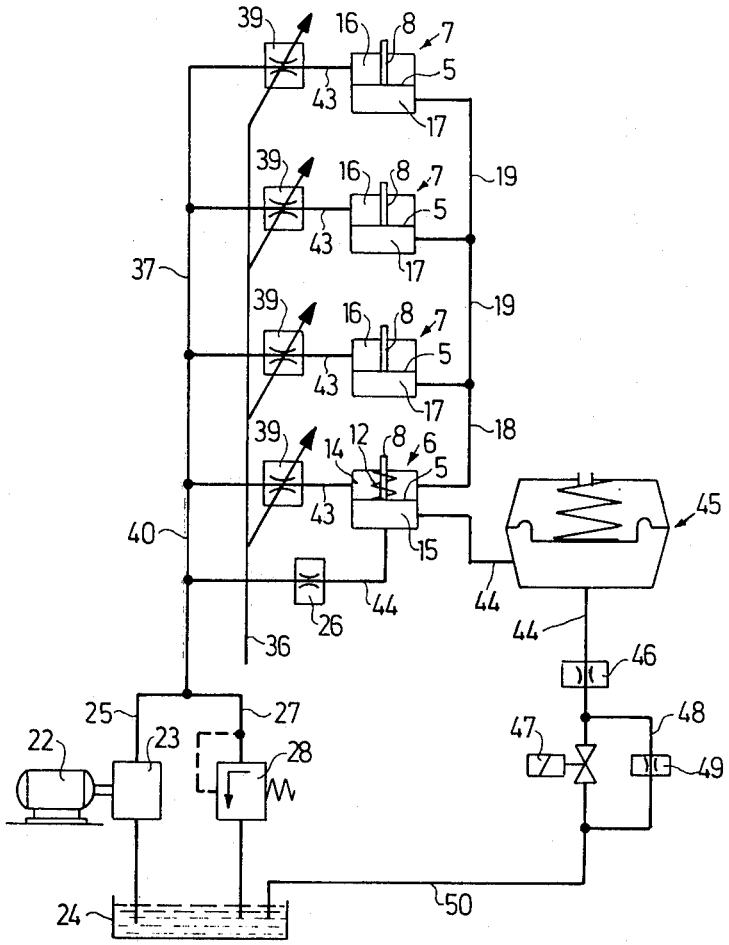
FIG. 3 is a diagrammatic view of the embodiment of the fuel injection system according to the present invention.

In the embodiment of the fuel injection system or distributor unit represented in FIGS. 1, 2 and 3, a housing 1, an intermediate plate 2 and a base closure 3 are axially tightened together by means of bolts 4. Between the housing 1 and the intermediate plate 2 there is clamped a membrane 5 which serves as the membrane for the membrane valves formed with the chambers or axial bores uniformly distributed about the center axis of the housing 1. The distributor unit shown is intended for a four-cylinder internal combustion engine and therefore has four membrane valves, one of which is in the form of a differential pressure control valve 6 and the other three of which are in the form of constant pressure valves 7. In the case of each of these valves the membrane forms a flat seat valve with a fixed valve seat 8. The valve seat 8 is held in a valve seat holder 9 which is threadedly secured in the housing 1. The valve seat holder 9 serves as a connecting part for lines 10 leading to the injection nozzle 11. A coil spring 12, the characteristic of which has as flat a course as possible, rests on the valve seat holder 9 of the differential pressure control valve 6. This coil spring 12 urges the membrane 5 via a spring plate 13 in the opening direction such that the differential pressure control valve 6 is open when inoperative. The membrane 5 both separates a first chamber 14 of the differential pressure control valve 6 from a second chamber 15 and also the first chambers 16 of the constant pressure valves 7 from the second chambers 17 thereof. A conduit 18 leads from the first chamber 14 of the differential pressure control valve 6 to the second chamber 17 of a constant pressure valve 7. The second chambers 17 of the constant pressure valves 7 are interconnected via an annular conduit 19.

Fuel is drawn from a fuel container 24 by a pump 23. The pump 23 is driven by an electromotor 22. The fuel is supplied via a line 25 and a first throttle 26 to the second chamber 15 of the differential pressure control valve 6. A line 27 branches off from the line 25. A pressure limiting valve 28, which allows fuel to flow back into the fuel container 24 when there is excessive pressure in the system, is connected in the line 27.

In an axial bore 30 of the distributor unit there is disposed a bearing sleeve 31. The bearing sleeve 31 is secured against displacement and rotation by means of an elastic packing sleeve 32, which may be made of rubber. The packing sleeve 32 is axially compressed by means of a plug 33 urging it against the base closure 3. This also ensures that no fuel will leak between the bearing sleeve 31 on the one hand and the housing 1 and the intermediate plate 2 on the other hand.

A servo valve spool or metering plunger 36 slides axially against the force of a spring 35. The spool 36 defines an annular groove 37. Pressure fluid could also be used in place of the spring 35 to cause a restoring force to act on the servo valve spool 36. The pressure fluid acting on the servo valve spool 36 would be controlled by a hydraulic control pressure system (not shown). In the bearing sleeve 31 are disposed longitudinal grooves 38 which communicate with the inner bore of the bearing sleeve 31 via identical axially parallel longitudinal metering or control slots 39. Depending on the position of the servo valve spool 36, the annular groove 37 controls a longer or shorter portion of the control slots 39. A fuel supply line 40 establishes a continuous communication between the annular groove 37 and the line 25. The longitudinal grooves 38 of the bearing sleeve 31 communicate with the first chamber 14 of the differential pressure control valve 6 or the first chambers 16 of the constant pressure valves 7 via channels 43. A longitudinal groove 38 with its control slot 39 is associated with each valve, and the first chambers 14 and 16 are separated from one another.

The first throttle 26 separates the fuel supply line 40 from a control pressure circuit 44 in which the second chamber 15 of the differential pressure control valve 6, a storage element 45, a second throttle 46 and a magnetic valve 47 are disposed in series. A third throttle 49 is disposed in a line 48 parallel to the magnetic valve 47. When the magnetic valve 47 is closed, the fuel from the control pressure circuit can flow through the throttle 49 via a return line 50 back to the fuel container 24.

OPERATION OF THE PREFERRED EMBODIMENT

The fuel delivered by the pump 23 is supplied via the line 25 and the first throttle 26 to the second chamber 15 of the differential pressure control valve 6. From the line 25 the fuel flows also via the fuel supply line 40 into the annular groove 37 of the servo valve spool 36. The servo valve spool 36 can be displaced in an axial direction, for example, by means of an air measuring element (not shown), so that the annular groove 37 opens the control slots 39 to a greater or lesser extent. From the annular groove 37 the fuel metered by the control slots 39 flows into the longitudinal grooves 38 and from there via channels 43 to the first chamber 14 of the differential pressure valve 6 and the first chambers 16 of the constant pressure valves 7. The first chamber 14 of the differential pressure valve 6 communicates with the second chambers 17 of the constant pressure valves 7 via the conduit 18, the second chambers 17 being interconnected by the annular conduit 19.

The stiffness of the membrane and the force of the spring 12 of the differential pressure control valve 6 are designed in such a manner that in case of a deviation from a predetermined pressure drop between the first chamber 14 and the second chamber 15, the flow passage section between the membrane and the valve seat continuously changes until said predetermined pressure drop is again obtained. By virtue of the valve structure described hereinbefore, this is accomplished in an extremely short time as even a small displacement of the membrane changes said flow passage section substantially. Because of the small displacement of the membrane 15, the force of the spring 12 only changes slightly and consequently control of the pressure drop proceeds in a very accurate manner.

The throttling of the fuel at the control slots 39 is practically uniform and thus a virtually uniform fuel pressure prevails in the first chamber 14 of the differential pressure control valve 6 and the first chambers 16 of the constant pressure valves 7. By virtue of the communication between the first chambers 14 of the differential pressure control valve 6 and the second chambers 17 of the constant pressure valves 7, the fuel pressure in these chambers is virtually identical with that in the chambers 16, even in the controlled state. The use of constant pressure valves offers the advantage that only the spring 12 of the differential pressure control valve 6 has to be selected to obtain the desired pressure difference at the metering valve 37, 39 and it is not necessary to adjust the individual constant pressure valves.

To adapt the fuel-air mixture to the operating conditions of the internal combustion engine, it may be necessary to change the pressure difference across the metering valves 37, 39. The differential pressure across the metering valves 37, 39 can preferably be regulated and adjusted in common with the pressure in the control pressure circuit 44. In the present embodiment the differential pressure is changed across the metering valves 37, 39 by changing the differential pressure across the first throttle 26, thus varying the quantity of fuel flowing through the first throttle. The quantity of fuel flowing through the first throttle 26 can be varied by virtue of the fact that a second throttle 46 and a magnetic valve 47 with a third throttle 49 disposed parallel therewith are connected after the first throttle in the control pressure circuit 44. When the magnetic valve 47 is closed, the quantity of fuel flowing through the first throttle 26 is determined by the throttles 26, 46 and 49. The quantity of fuel flowing in the control pressure circuit when the magnetic valve 47 is open is determined only by the throttles 26 and 46. This results in a reduced throttling action and an increased pressure difference across the first throttle 26. Thus, the pressure difference across the metering valves 37, 39 is also increased. The pressure difference across the first throttle 26 can be changed by varying the duration of opening of the magnetic valve 47 relative to the duration of closing of the same. With a continuously closed magnetic valve 47 there is obtained a minimal pressure difference and a low fuel-air mixture and with a continuously open magnetic valve 47 the pressure difference is greatest and the fuel-air mixture richest.

This type of differential pressure alteration as a function of the characteristic data of the engine does not mean that the differential pressure across the metering valve should be constantly changed but that the differential pressure is only to be changed thereby to another value and then kept constant at this value.

The control pulses are supplied to the magnetic valve 47 through the characteristic data of the engine, either measured electronically or converted into electrical quantities, influencing the opening duration via an electrical control device. For example, control can be effected by means of the oxygen content in the exhaust gas, a so-called oxygen sensing element being disposed in the exhaust gas line of the internal combustion engine.

The storage element 45 is disposed between the second chamber 15 of the differential pressure control valve 6 and the second throttle 46 in the control pressure circuit 44 to absorb pressure surges.

What is claimed is:

1. In a fuel injection system for externally ignited internal combustion engines comprising: a plurality of fuel injection valves; a distributor unit; means including a fuel supply line for supplying fuel to the distributor unit; and means connecting the injection valves to the distributor unit, the distributor unit including: a plurality of metering valves which are displaceable in common to vary their flow passage section and which regulate the quantity of fuel flowing to the injection valves, the metering operation being carried out with a constant pressure difference; an equal plurality of pressure valves, at least one of which is in the form of a differential pressure control valve and the remainder of which are in the form of constant pressure valves; and means connecting the pressure valves to respective ones of the metering valves, said pressure valves being located in the fuel flow downstream of the metering valves, the pressure valves each including: a first chamber; a second chamber; and a flexible member separating the first chamber from the second chamber, said flexible member serving to vary the flow passage section of its pressure valve, said pressure valves being arranged so that the pressure of the fuel downstream of the metering valves is communicated to the first chambers of the pressure valves which tends to urge the flexible member of the respective pressure valve in an opening direction and so that the first chamber of the differential pressure control valve communicates with the second chambers of the constant pressure valves, the improvement comprising:

a. a first throttle; and b. a control pressure circuit including the second chamber of the differential pressure control valve, a magnetic valve, a storage element and a second throttle wherein:

i. the first throttle is disposed between the fuel supply line and the control pressure circuit;

ii. the first chamber of the differential pressure control valve is disposed downstream of the first throttle; and iii. the pressure difference across the metering valves may be varied by varying the pressure difference across the first throttle by means of the magnetic valve via the storage element and the second throttle.

2. The fuel injection system as defined in claim 1, wherein the storage element, the second throttle and the magnetic valve are connected in series in the control pressure circuit.

3. The fuel injection system as defined in claim 2, wherein the control pressure circuit further includes a third throttle disposed in parallel with the magnetic valve.

4. The fuel injection system as defined in claim 1, wherein each constant pressure valve is in the form of flat seat valve having a membrane as the flexible member.

5. The fuel injection system as defined in claim 1, wherein the differential pressure control valve is in the form of a flat seat valve having a membrane as the flexible member, said membrane being urged in the opening direction by a spring having a flat characteristic.

* * * * *